US008087218B2

(12) United States Patent
Harding

(10) Patent No.: US 8,087,218 B2
(45) Date of Patent: Jan. 3, 2012

(54) PACKAGING METHOD WITH VOID-FILL DENSITY DETERMINATION

(75) Inventor: Joseph J. Harding, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 834 days.

(21) Appl. No.: 12/022,423

(22) Filed: Jan. 30, 2008

(65) Prior Publication Data

US 2008/0115464 A1 May 22, 2008

Related U.S. Application Data

(63) Continuation of application No. 10/700,364, filed on Nov. 3, 2003, now Pat. No. 7,337,595.

(60) Provisional application No. 60/423,080, filed on Nov. 1, 2002.

(51) Int. Cl.
*B65B 1/44* (2006.01)

(52) U.S. Cl. ..... 53/503; 53/52; 53/504; 493/967

(58) Field of Classification Search ..... 493/464, 493/967; 53/501, 503, 504, 52
See application file for complete search history.

(56) References Cited

U.S. PATENT DOCUMENTS

| | | | |
|---|---|---|---|
| 2,101,170 | A | 12/1937 | Engel |
| 2,109,294 | A | 2/1938 | Kimball et al. |
| 2,569,589 | A | 10/1951 | Trissell |
| 2,882,802 | A | 4/1959 | Walker |
| 3,377,771 | A | 4/1968 | Schmidt |
| 3,509,797 | A | 5/1970 | Johnson |
| 3,603,216 | A | 9/1971 | Johnson |
| 3,613,522 | A | 10/1971 | Johnson |
| 3,651,465 | A | 3/1972 | Law et al. |
| 3,695,133 | A | 10/1972 | Finke |
| 3,709,756 | A | 1/1973 | Watson |
| 3,743,140 | A | 7/1973 | Sauerbrey |

(Continued)

FOREIGN PATENT DOCUMENTS

DE 27 41 443 3/1979

(Continued)

OTHER PUBLICATIONS

International Search Report of International Application No. PCT/US2003/34930, published as International Publication No. WO 2004/041653 on May 21, 2004.

*Primary Examiner* — Christopher Harmon
(74) *Attorney, Agent, or Firm* — Renner, Otto, Boisselle & Sklar, LLP

(57) ABSTRACT

A system, and associated components and methodology, that provides for automatic determination and supply of an amount of dunnage to fill the void left in a container in which one or more objects have been placed. The system comprises a dunnage dispenser which is operable to dispense a controlled amount of a dunnage, a container scanner, and a logic device. The container scanner includes a height sensor for sensing a height characteristic of a container, a width sensor for sensing a width characteristic of the container, and a contour sensor for sensing a contour characteristic of the objects in the container. The logic device can (1) process sensed characteristic information from the height sensor, width sensor and contour sensor, (2) determine the amount of dunnage needed to fill the void not occupied by the objects, and (3) command the dunnage dispenser to dispense the determined amount of dunnage.

19 Claims, 5 Drawing Sheets

U.S. PATENT DOCUMENTS

| | | | | |
|---|---|---|---|---|
| 3,744,360 | A | | 7/1973 | Currie et al. |
| 3,760,669 | A | | 9/1973 | Rosenthal et al. |
| 3,799,039 | A | | 3/1974 | Johnson |
| 3,819,918 | A | | 6/1974 | Hale |
| 3,949,856 | A | | 4/1976 | Ulber et al. |
| 4,026,198 | A | | 5/1977 | Ottaviano |
| 4,071,911 | A | | 1/1978 | Mazur |
| 4,085,662 | A | | 4/1978 | Ottaviano |
| 4,109,040 | A | | 8/1978 | Ottaviano |
| 4,237,776 | A | | 12/1980 | Ottaviano |
| 4,541,228 | A | | 9/1985 | Petersen |
| 4,548,286 | A | | 10/1985 | Sashiki et al. |
| 4,557,716 | A | | 12/1985 | Ottaviano |
| 4,650,456 | A | | 3/1987 | Armington |
| 4,699,031 | A | | 10/1987 | D'Angelo et al. |
| 4,699,609 | A | | 10/1987 | Komaransky et al. |
| 4,705,552 | A | | 11/1987 | Liska et al. |
| 4,717,613 | A | | 1/1988 | Ottaviano |
| 4,719,449 | A | | 1/1988 | Cousseau |
| 4,750,896 | A | | 6/1988 | Komaransky et al. |
| 4,884,999 | A | | 12/1989 | Baldacci |
| 4,922,687 | A | | 5/1990 | Chow et al. |
| 4,924,506 | A | | 5/1990 | Crossley et al. |
| 4,968,291 | A | | 11/1990 | Baldacci et al. |
| 5,062,052 | A | | 10/1991 | Sparer et al. |
| 5,088,972 | A | | 2/1992 | Parker |
| 5,109,347 | A | | 4/1992 | Quick, Jr. et al. |
| 5,123,889 | A | | 6/1992 | Armington et al. |
| 5,149,075 | A | | 9/1992 | Crowley et al. |
| 5,180,157 | A | | 1/1993 | Helit et al. |
| 5,194,720 | A | | 3/1993 | Reinnagel et al. |
| 5,211,620 | A | | 5/1993 | Ratzel et al. |
| 5,212,531 | A | | 5/1993 | Monma et al. |
| 5,292,238 | A | | 3/1994 | Michalak |
| 5,303,585 | A | | 4/1994 | Lichte |
| 5,322,477 | A | | 6/1994 | Armington et al. |
| 5,418,713 | A | | 5/1995 | Allen |
| 5,442,983 | A | | 8/1995 | D'Angelo et al. |
| 5,460,209 | A | | 10/1995 | Jandura et al. |
| 5,483,052 | A | | 1/1996 | Smith, III et al. |
| 5,719,678 | A | | 2/1998 | Reynolds et al. |
| 5,778,631 | A | | 7/1998 | Simmons |
| 5,800,262 | A | | 9/1998 | Andersen et al. |
| 5,864,484 | A | | 1/1999 | Harding |
| 5,871,429 | A | * | 2/1999 | Harding et al. ..... 493/25 |
| 5,876,318 | A | | 3/1999 | Ratzel |

FOREIGN PATENT DOCUMENTS

| | | |
|---|---|---|
| DE | 33 15 520 | 11/1983 |
| DE | 37 00 146 | 7/1988 |
| DE | 274 188 | 12/1989 |
| GB | 2 205 406 | 12/1998 |
| JP | 62-91697 | 10/1994 |
| WO | 95/13914 | 5/1995 |
| WO | 96/37361 | 11/1996 |

* cited by examiner

PACKAGING METHOD WITH VOID-FILL DENSITY DETERMINATION

This application is a continuation of U.S. patent application Ser. No. 10/700,364, filed Nov. 3, 2003 now U.S. Pat. No. 7,337,595, which is hereby incorporated herein in its entirety, and which claims the benefit of U.S. Provisional Application No. 60/423,080, filed Nov. 1, 2002.

FIELD OF THE INVENTION

The invention herein described relates generally to a packaging system for providing a controlled quantity of dunnage material for top-filling a container in which one or more objects are packed for shipping.

BACKGROUND OF THE INVENTION

In the process of shipping one or more articles, products or other objects in a container, such as boxes/cartons, from one location to another, a protective packaging material or other type of dunnage material is typically placed in the shipping container to fill any voids and/or to cushion the item during the shipping process. Some commonly used dunnage materials are plastic foam peanuts, plastic bubble pack, air bags and converted paper dunnage material.

In many instances, the dunnage material is used to top-fill a container in which one or more objects have been placed, thereby to fill any remaining void in the container and thus prevent or minimize any shifting movement of the object or objects in the container during shipment. If an automated dispenser is used to supply dunnage material for filling the box, perhaps the most prevalent practice today is for the operator of the dispenser to observe the container as it is being filled with dunnage material and stop the dispenser when the container appears to be full. Automated dispensers include, for example, plastic peanut dispensers often associated with an air delivery system, air bag machines and paper dunnage converters.

A common tendency is for the operator to overfill the container, with the result that more dunnage material may have been placed in the container than was needed adequately to protect the object or objects packed in the container. In other instances, the operator may put too little dunnage material in the container with the result that the object or objects packed in the container can be damaged during shipment. Over-filling and under-filling typically becomes more of a problem as the speed of the dispenser increases. Today, there are void-fill dispensers, in particular paper dunnage converters, that can deliver a strip of dunnage material at rates in excess of 50 feet per minute (about 0.25 meters per second).

A basic solution for the aforesaid problem is disclosed in U.S. Pat. No. 5,871,429. The '429 patent discloses a packaging system comprising a probe for sensing the void in a container and a dunnage converter having a controller for controlling the feeding and cutting of a strip of dunnage material such that there is produced the amount of dunnage material needed to fill the void in the container. As mentioned in the '429 patent, a mechanical probe may be used to probe a container in one or more locations to determine the amount of dunnage material needed to fill the void. The mechanical probe may also be used in conjunction with a bar code reader or used in conjunction with or supplanted by sensors which sense the dimensions or degree of fill of the container, including optical and ultrasonic sensors.

While the above-described system of the '429 patent represents a major advance in the art, a need still exists for improved devices and methods for implementing the basic solution taught in the '429 patent.

SUMMARY OF THE INVENTION

The present invention provides a system, and associated components and methodology, that provides for automatic determination and supply of an amount of dunnage material sufficient to fill the void left in a container in which one or more objects have been placed.

According to one aspect of the invention, such a system comprises a dunnage dispenser which is operable to dispense a controlled amount of a dunnage material, a container scanner having a scan area, and a logic device. The container scanner includes a height sensor for sensing a height characteristic of a container, a width sensor for sensing a width characteristic of the container, and a contour sensor for sensing a contour characteristic of the one or more objects in the container. The logic device is operable (1) to process sensed characteristic information received from the height sensor, width sensor and contour sensor, (2) to determine the amount of dunnage material needed to fill the void left in the container not occupied by the one or more objects, and (3) to command the dunnage dispenser to dispense the determined amount of dunnage material.

In a preferred embodiment of a void-fill system according to the invention, a conveyor conveys the container through the scan area, and the logic device calculates a length characteristic of the container as a function of the sensed characteristic information received from at least one of the sensors and the rate at which the conveyor conveys the container through the scan area. In addition, the contour sensor may continuously sense the top surface of the one or more objects in the container as the container is moved through the scan area by the conveyor.

According to another aspect of the invention, a void-fill system for automatically determining and producing an amount of dunnage material sufficient to fill the void left in a container in which one or more objects have been placed, comprises a dunnage dispenser which is operable to dispense a controlled amount of a dunnage material; a void-measuring apparatus which measures the amount of void left in a container after one or more objects have been placed in the container, the void-measuring apparatus being operative to command the dunnage dispenser to dispense a prescribed amount of dunnage material; and an input device connected to the void-measuring apparatus that enables selection of a void-fill density from a plurality of void-fill densities, and wherein the void-measuring apparatus, in response to a selected void-fill density, varies the amount of dunnage material that the dunnage dispenser is commanded to dispense per measured volume of void, thereby to obtain the selected void-fill density.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION OF THE INVENTION

Figure 1:
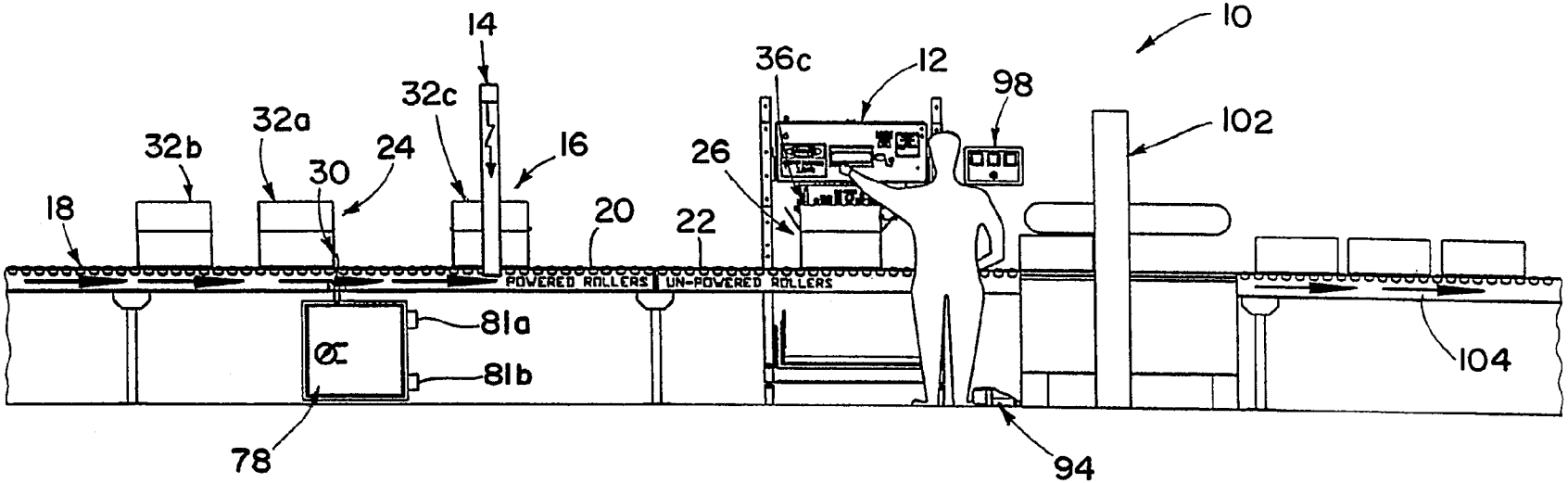
FIG. 1 is a schematic illustration of an exemplary void-fill measuring and dispensing system according to the invention.

Referring now in detail to the drawings and initially to FIG. 1, an exemplary void-fill measuring and dispensing system according to the invention is indicated generally at 10. The system 10 is operative to automatically determine and supply an amount of dunnage material sufficient to fill the void left in a container in which one or more objects have been placed.

The system 10 generally comprises a dunnage dispenser 12 which is operable to dispense a controlled amount of a dunnage material, a container scanner 14 having a scan area 16, and a container conveyor 18 for conveying a container through the scan area. The container conveyor (which may form at least part of a packing line conveyor) preferably has a powered section 20 and an un-powered section 22. In the illustrated embodiment, the powered section 20 extends at least from a container holding station 24, through the scan area 16 and to the un-powered section 22. The un-powered section 22 extends from the powered section 20 through a dunnage fill area 26 proximate the dunnage dispenser 12. The conveyor 18 can be of any suitable type such as the illustrated roller conveyor.

At the holding station 24 the conveyor 18 has associated therewith a stop gate 30 of any suitable type for controllably permitting passage of containers into the scan area 16. In the illustrated preferred embodiment, the stop gate 30 is a retractable stop member which in an extended position will block passage of a container 32*a* and thereby hold the container 32*a* at the holding station. When the stop member 30 is retracted, the container 32*a* is allowed to move out of the holding station 24 by the action of the powered section 20 of the conveyor 18. Shortly after the container 32*a* is released, the stop member 30 is extended to capture and hold the next container 32*b* at the holding station 24, whereby containers are controllably fed into and through the scan area 16.

Figure 3:
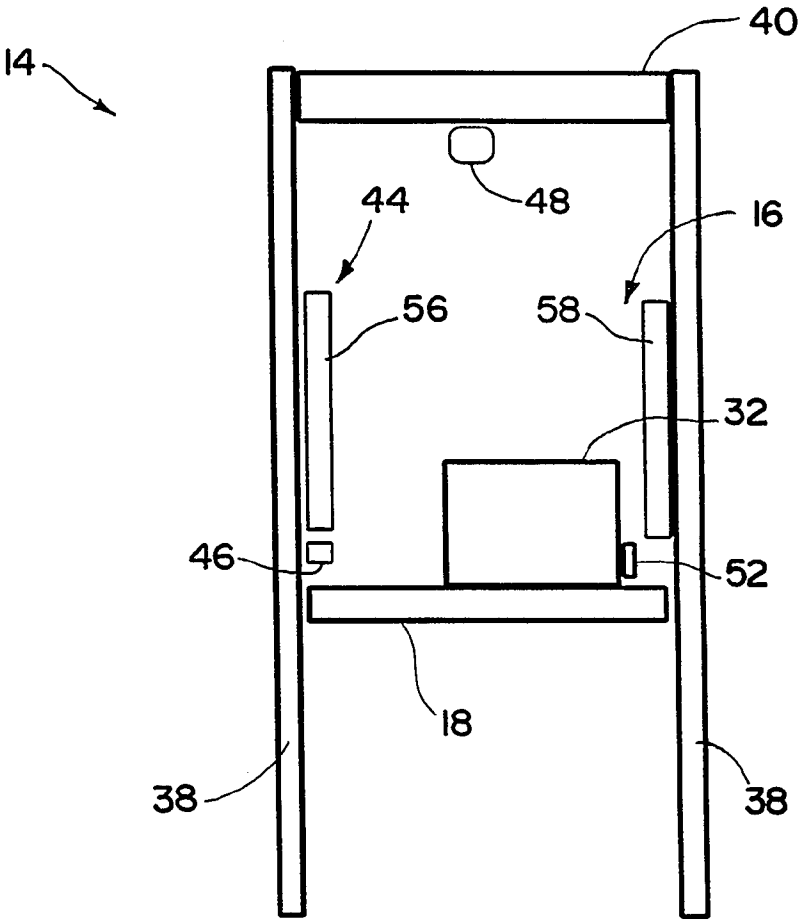
FIG. 3 is an end view of the container scanner of FIG. 2, looking from the line 3-3 of FIG. 2.
Figure 2:
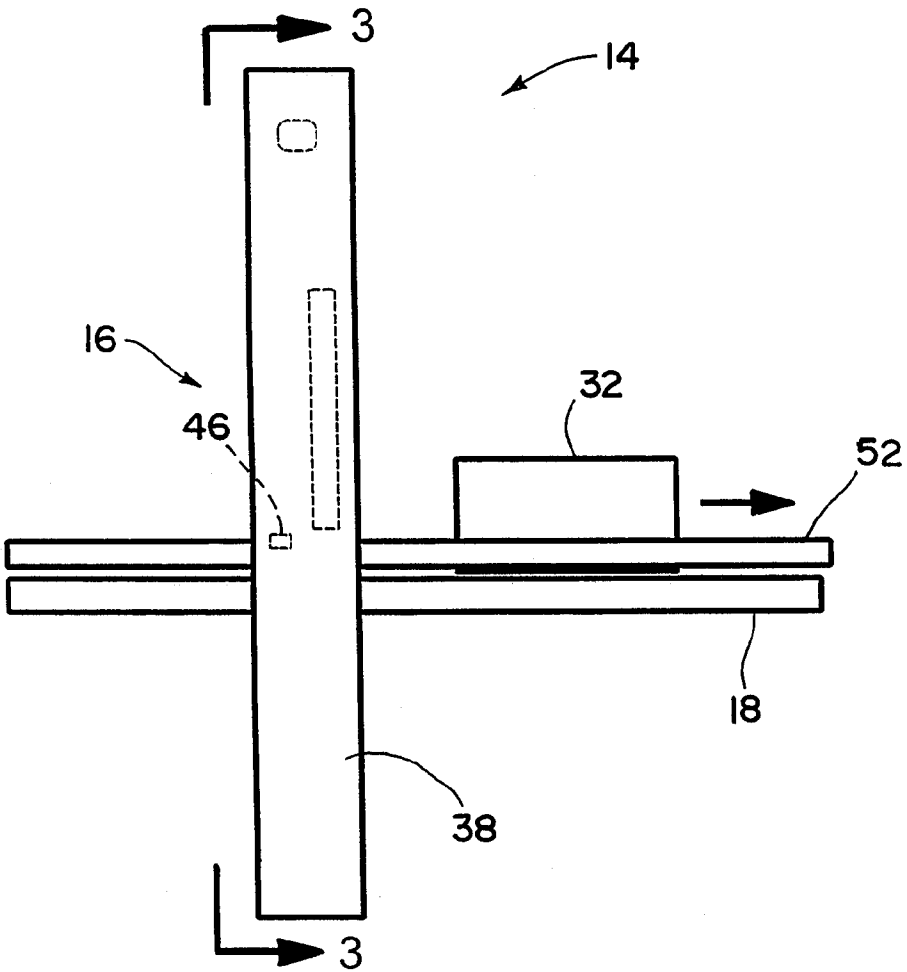
FIG. 2 is a schematic of the container scanner used in the system of FIG. 1.

In FIGS. 2 and 3, the exemplary container scanner 14 can be seen to include a frame 38 having a pair of uprights straddling the container conveyor 18 and a cross beam 40 supported atop the uprights at a fixed distanced from the container conveyor 18. The uprights, for example, can be floor supported as shown in FIGS. 2 and 3, or can be mounted to the conveyor 18 as illustrated in FIG. 1.

The container scanner 14 further comprises one or more sensors which may be infrared, ultrasonic, laser or other type of sensors. In the illustrated preferred embodiment, the sensors are a height sensor 44 for sensing a height characteristic of a container, a width sensor 46 for sensing a width characteristic of the container, and a contour sensor 48 for sensing a contour characteristic of the one or more objects in the container.

The contour sensor 48, shown mounted to the cross beam 40 above the scan area 16, preferably is of a type that continuously senses the top surface of the one or more objects in the container, such as container 32*c*, as the container is moved through the scan area 16 by the conveyor. An exemplary contour sensor is a non-contact optic laser scanner that operates by measuring the time of flight of laser light pulses, such as the Sick Optic LMS 200-30106 laser scanner. A pulsed laser beam is emitted by the laser scanner and reflected if it meets an object. The reflection is registered by the laser scanner's receiver. The time between transmission and reception of the reflected impulse is directly proportional to the distance between the laser scanner and the object. The pulsed laser beam can be deflected by an internal rotating mirror so that a fan-shaped scan is made of the surrounding area, whereupon the contour of the object (i.e., distance from a fixed reference point/plane) is determined from the sequence of impulses received. The fan beam is oriented perpendicular to the movement path of the container through the scan area 16, whereby the contour of the objects is progressively measured as the container moves through the scan area 16. As will be appreciated, the measurement data can be supplied in real time via suitable communication means.

The width sensor 46 can be any suitable sensor for measuring the width of the container passing through the scan area. In the illustrated embodiment, the width sensor 46 is an infrared distance sensor that can be used to measure the distance a side of the container is spaced from the sensor or other reference point. In order for this to yield the width of the container, the location of the other side of the container must be registered at a known fixed distance from the width sensor 46 which, as shown, can be mounted to one of the uprights of the scanner frame 38 at a location just above the level of the conveyor. To this end, the containers are registered against a guide rail 52 on the side of the conveyor 18 opposite the width sensor, which guide rail 52 is at a known distance from the width sensor and thus functions as a zero reference. Accordingly, the width of the container will be the difference between the location of the guide rail 52 and the measured location of the side of the container nearest the width sensor 46. Any suitable means may be employed to register the container against the guide rail 52.

The height sensor 44 can be any suitable sensor for determining a height characteristic of the container in the scan area 16. An exemplary sensor 44 includes an array 56 of emitters and an array 58 of receivers disposed on opposite transverse sides of the scan area. In the illustrated exemplary embodiment, the emitter and receiver arrays 56 and 58 are mounted respectively to the scanner frame uprights 38. Each array includes a row of emitters/receivers that is oriented perpendicular to the plane of the conveyor 18. Accordingly, the emitter array 56 produces a curtain of light that is sensed by the receiver array 58. As a container moves through the curtain, the curtain will be interrupted by the container up to the height of the container, whereby a measurement of the container height is obtained.

Figure 4:
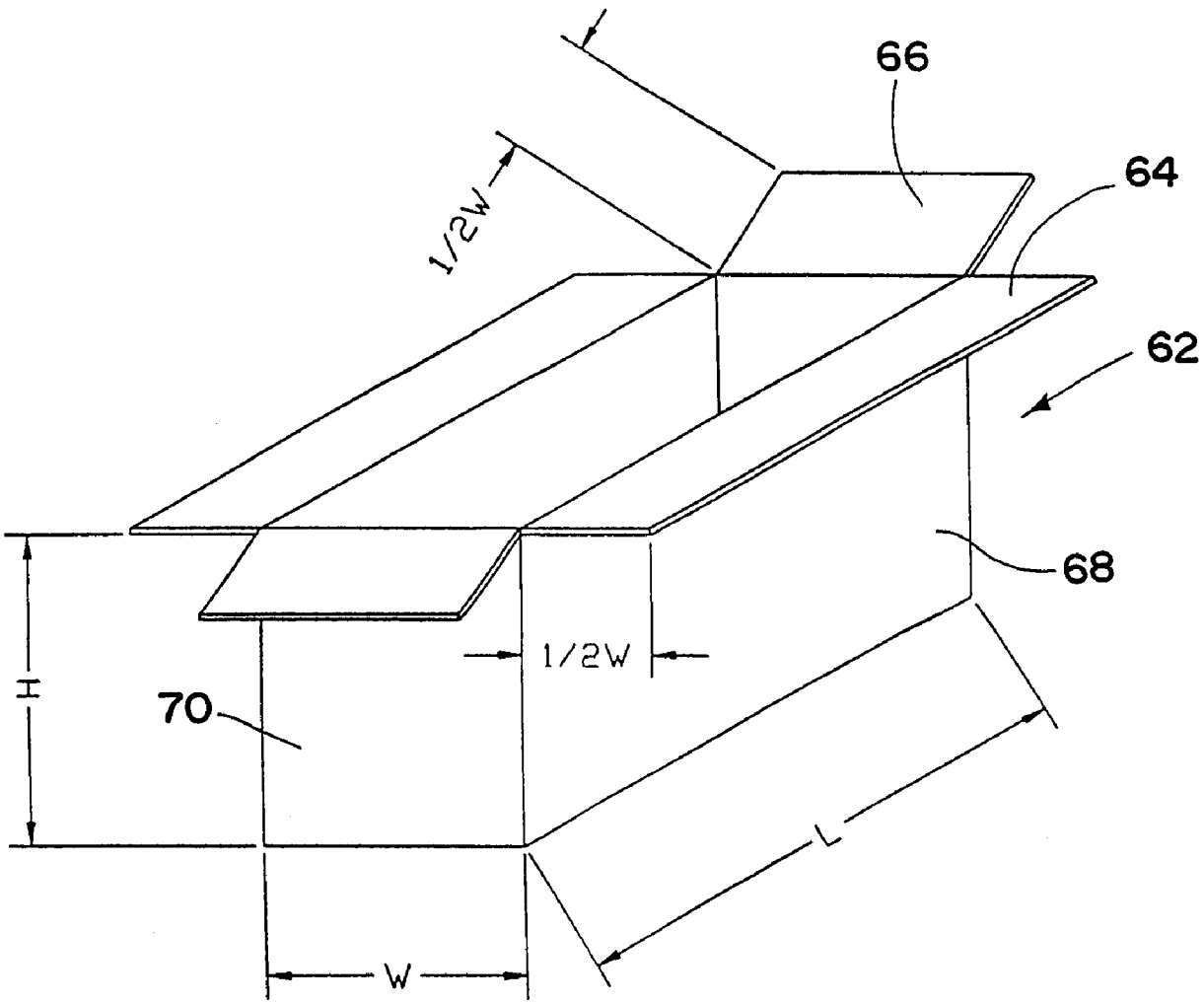
FIG. 4 is a perspective view of a standard regular slotted container (RSC).

In the illustrated embodiment, the system 10 is configured for use with regular slotted containers (RSCs). As illustrated in FIG. 4, an RSC 62 has a specified relationship between the width of the container W and the height of the side flaps 64 and end flaps 66. That is, the flaps 64 and 66 have a height one half the width W of the container. Accordingly, the height H of the side walls 68 and end walls 70 of the container (i.e., the height of the container when closed) can be determined from a measure of the height of the container with the top flaps 64 and 66 upright in their unfolded state. The height of the side and end walls (the height of the object containing portion of the container) will be two thirds the height of the container when the top flaps 64 and 66 are upright and unfolded. While the illustrated embodiment measures the height of the container with the top flaps 64 and 66 upright and unfolded, those skilled in the art will appreciate that the height H can be otherwise measured, such as when the flaps 64 and 66 are folded down, thereby giving a direct measurement of the height of the side and end walls of the container.

A separate sensor could be provided to measure the length of the container. However, in the illustrated embodiment, the container length is determined indirectly by measuring the length of time the container takes to pass any one of the sensors, such as the width sensor 46, and by knowing the speed at which the conveyor 18 is moving the container past the sensor. The length of time multiplied by the speed of the conveyor yields the length of the container. If the speed of the conveyor is a known constant, then only the length of time needs to be sensed in order to obtain the length of the container. If the speed of the conveyor varies or for other reasons, the conveyor speed sensor 96 can be used to sense the conveyor speed and communicate the same to the control unit 76 for processing. The speed sensor, for example, can be an encoder interfaced with the conveyor drive motor for providing a series of pulses, the rate of which are proportional to the speed of the motor and thus the conveyor. The control unit can be calibrated to convert the pulse rate to a container speed that can be multiplied with the container passage time measured by the width sensor.

Figure 5:
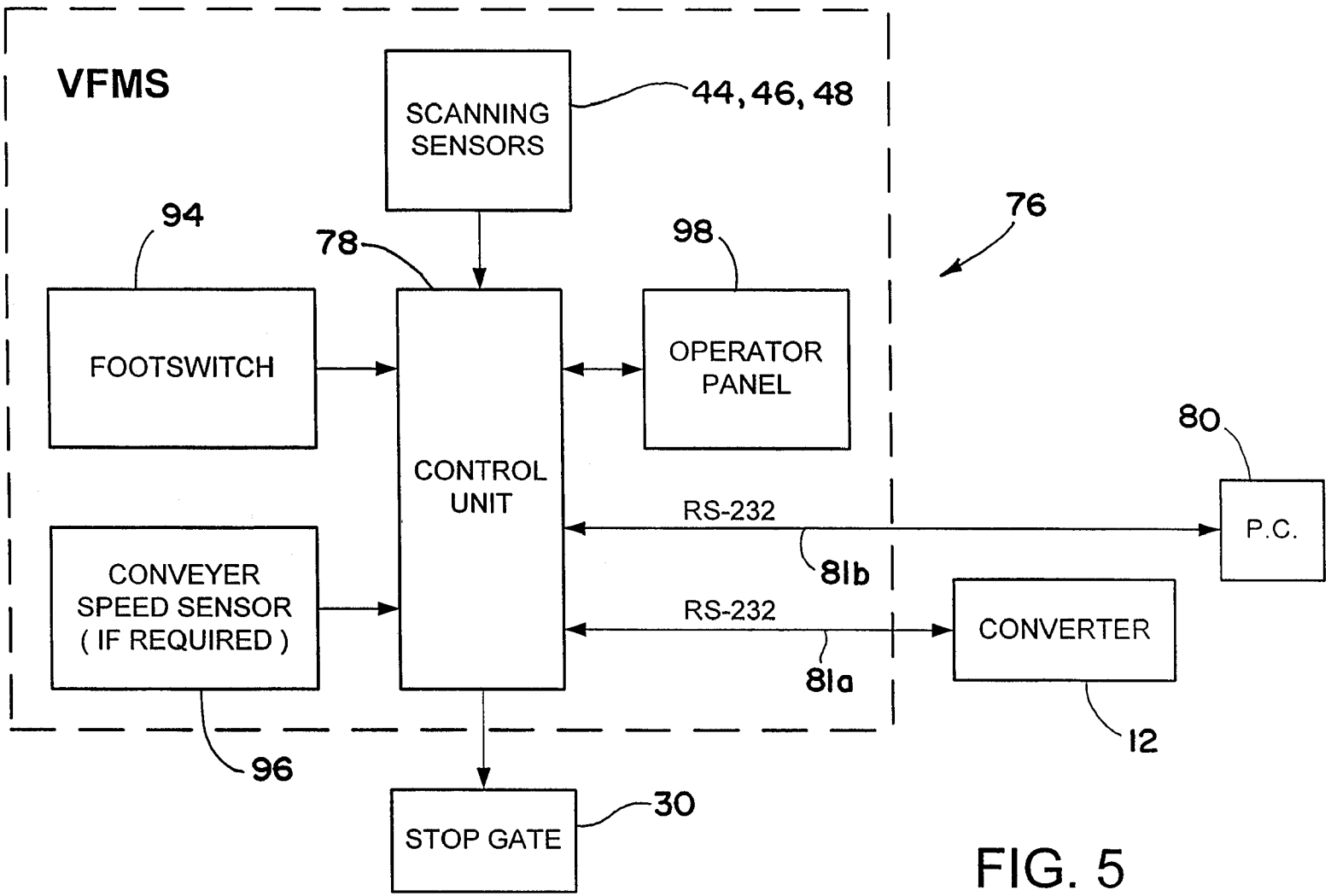
FIG. 5 is a block diagram of a logic device used to control the void-fill measuring and dispensing system of FIG. 1.

The various operative components of the system 10 are controlled by a logic device 76 which is diagrammatically shown in FIG. 5. The various functions of the logic device 76 may be performed by a single controller, such as a control unit 78 for the container scanner 14. However, it may be desirable to distribute the functions of the logic device 76 among several controllers each having separate processors, such as among the control unit 78, the controller for the dunnage dispenser and/or a microprocessor of a personal computer 80. As used herein, the logic device 76 encompasses the processor or processors of the system that control the operation of the system 10. The processor may be any one of a number of commercially available processors such as PLCs and general purpose processing chips with various output and input ports and associated memory devices including ROM and RAM. The logic device may be controlled by suitable software that among other things uses data received from the scanning sensors to determine container length, width, height and top void fill volume.

Figure 6:
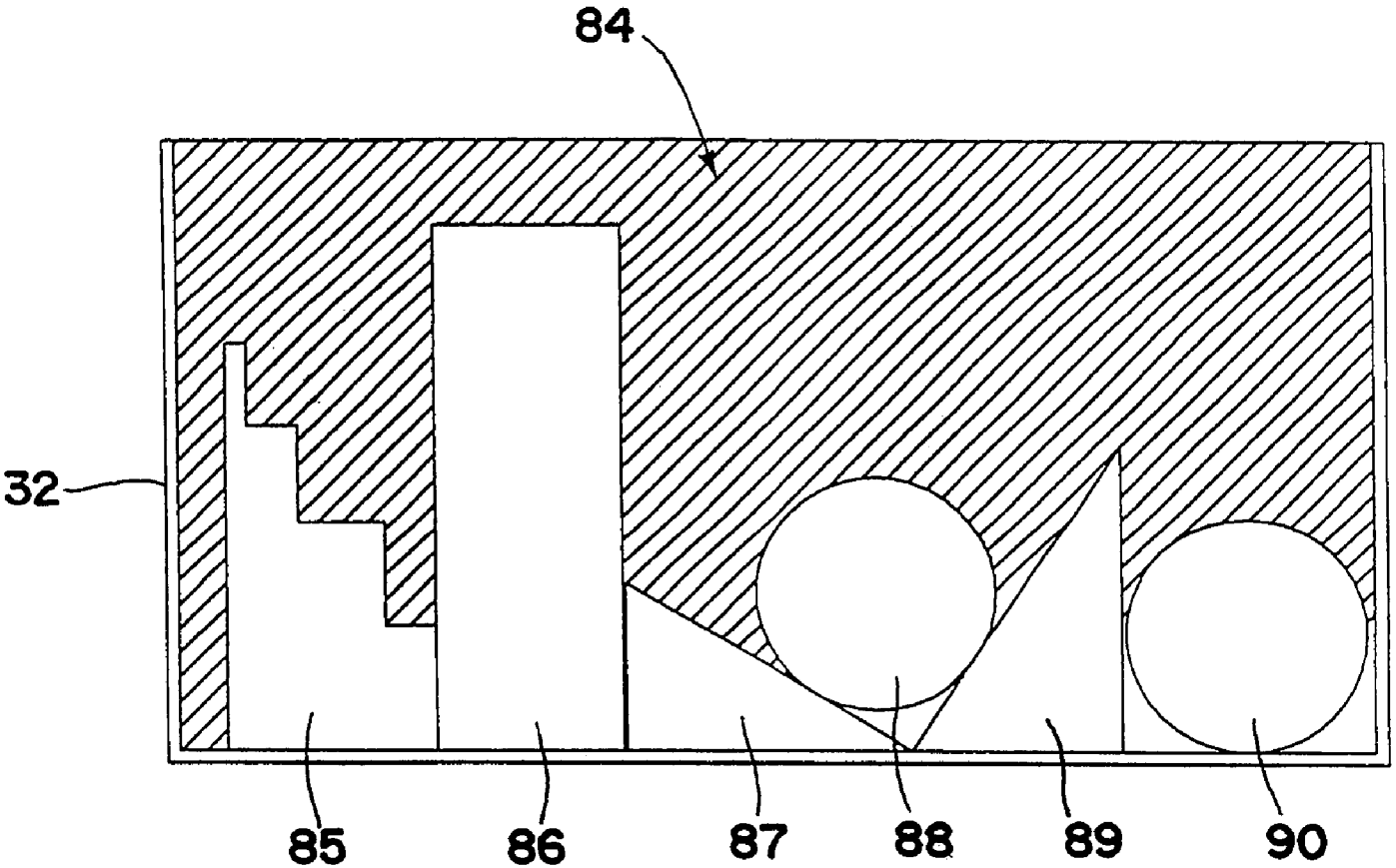
FIG. 6 is a schematic cross-sectional view of a container in which several objects have been placed and with the remaining void being denoted by cross-hatching.

Generally the logic device 76 is operable to process sensed characteristic information received from the height sensor 44, width sensor 46 and contour sensor 48. The logic device 76 then determines the amount of dunnage material needed to fill the void left in the container above the one or more objects that have been placed in the container (or the bottom wall of the container if not overlain by an object). In FIG. 6, this void is illustrated by the cross-hatching 84 while the objects in the container 32 are indicated at 85-90. After the amount of dunnage material to top fill the container is determined, the logic device 76 commands the dunnage dispenser 12 to dispense automatically the determined amount of dunnage material. The dunnage material can flow directly into the container and/or be placed or guided by an operator into the container.

In the illustrated exemplary system, the dunnage dispenser 12 is a dunnage converter which converts one or more plies of sheet stock material (typically kraft paper) into a relatively less dense dunnage material. Exemplary dunnage converters are shown in U.S. Pat. No. 5,123,889 and in published PCT Patent Application No. PCT/US01/18678, published under International Publication No. WO 01/94107, which are hereby incorporated herein by reference in their entireties. Other types of dunnage dispensers can be used, such as other types of paper dunnage converters, dispensers for plastic peanuts, etc. Many such dispensers are today controlled by microprocessors which can readily be interfaced with the control unit 78 and/or programmed to carry out one or more of the herein described functions of the logic device 76. In the case of a dunnage converter, the dunnage material can be produced on site and in response to a command from the logic device 76.

As illustrated in FIG. 5, the control unit 78 can be interfaced with the dunnage dispenser 12 and with a personal computer 80 by RS-232 serial connections 81*a* and 81*b*. The control unit 78 is equipped with various ports for connection with the scanner sensors 44, 46 and 48, with a foot switch 94, with an optional conveyor speed sensor 96, with the stop gate 30 and with an operator panel 98. As seen in FIG. 1, the foot switch 94 and operator panel 98 preferably are located in the vicinity of the dunnage dispenser 12 for use by the human operator/packer. Their function will become apparent from the following description of the operation of the system 10.

The above-described exemplary system 10 is operated in the following manner. As depicted in FIG. 1, containers 32 that contain one or more objects, such as products for shipping, are conveyed by the powered section 20 of the conveyor 18 towards the void-fill scanner 14. The containers are justified by suitable means to one side of the powered roller conveyor, and preferably against the guide rail 52 (FIGS. 2 and 3). The containers are stopped on the conveyor by the stop gate 30 before entering the scan area 16. When the operator steps on the foot switch 94, the control unit 78 instructs the stop gate 30 to release the leading container for movement into and through the scan area 16. After the container is released, the stop gate is commanded back to its capture position to prevent the next container from moving to the scan area 16 until later commanded by the logic device 76.

As the container moves through the scan area 16, it is scanned by the sensors 44, 46 and 48. After scanning, the container enters the non-powered section 22 of the conveyor where an operator can reach and then position the container in front of the outlet of the dunnage converter 12. The operator then steps on the foot switch 94 again to cause the apparatus to command the dunnage dispenser 12 to dispense the amount of dunnage material needed to top fill the container. After the container has been filled with dunnage, it can be passed on for further processing, such as through a container closer 102 and then onto a further powered conveyor 104.

Although the foregoing is a preferred way to operate the system, other ways for operating the system are contemplated by the present invention. For example, after the dunnage converter is commanded to provide the determined amount of dunnage material needed to fill the void left in the container, the dunnage converter or other dunnage dispenser can dispense the dunnage material in different ways. The dunnage material can be dispensed by the operator-initiated method described above, or, alternatively, the operator can stop the dunnage converter from dispensing dunnage material, if needed to catch up with the dunnage converter, for example, and then depress the foot switch again. The dunnage converter would then continue to dispense dunnage material until the determined amount of dunnage is produced and then automatically stop.

During the aforesaid process, the status of the operation can be indicated by suitable indicators on the operator panel 98. For example, there may be provided a power-on indicator, a scan-complete indicator, a scan-fault indicator and a converter-ready indicator. Preferably the foot switch 94 is enabled only when the converter-ready light is on and the scan-fault indicator light is off. The scan-fault indicator when lit may indicate a no-container-detected condition, a measured container size below minimum and/or above maximum, and/or a measured top void volume that is negative (no object in the container) or exceeds container volume (container overfull).

The logic device 76 may also be equipped with one or more input devices such as a mouse, a keyboard, a keypad, a touch screen, etc. For example, the operator panel 98 can be equipped with a touch screen as an input device, or the personal computer 80 may have a touch screen or other input device associated therewith. In this manner, a scan reset input is provided to enable the operator to clear a fault condition or reset the system for some other reason. The operator panel and/or personal computer can have a monitor for displaying the various indicators and/or other information, such as the measured dimension of the container, the total volume of the container, the volume of the contents of the container, and the volume of the void above the container contents.

Additionally, the operator panel and/or personal computer may be provided with a selector device enabling the selection of a void-fill density from a plurality of void-fill densities. In accordance with the selected void-fill density, the logic device 76 varies the amount of dunnage material to be dispensed per measured volume of void, thereby to provide the selected void-fill density. That is, the logic device 76 can be programmed to have a default setting where it will command X amount of dunnage to be dispensed for each unit volume of measured void. However, if minimal protection is needed, for example, the operator may select a lower void-fill density where in response the logic device 76 will command, for example, 10% less dunnage material to be dispensed per given unit of measured top-fill void. This will result in a lower density fill of the container and will consume a smaller quantity of dunnage material. On the other hand, if greater protection is needed and/or the objects packed in the container are heavier, the operator may select a higher void-fill density where in response the logic device 76 will command say 10% more dunnage material to be dispensed per given unit of measured top-fill void. The input device may be a dial whereby a desired density can be dialed in, a mouse pointer, a touch screen with one or more input regions, a keyboard or keypad for entry of a desired void-fill density, etc.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of the several embodiments, such feature may be combined with one or more other features of the other embodiments as may be desired and advantageous for any given or particular application.

What is claimed is:

1. A packaging apparatus comprising means for identifying a desired void-fill density, means for determining a void volume in a container, and means for commanding a dunnage dispenser to dispense an amount of dunnage to fill the void volume at the desired density.

2. An apparatus as set forth in claim 1, wherein the identifying means includes a selector device.

3. An apparatus as set forth in claim 2, wherein the selector device includes one or more of a dial, a mouse, a keyboard, a keypad, and a touch screen.

4. An apparatus as set forth in claim 1, wherein the determining means includes a one or more sensors.

5. An apparatus as set forth in claim 4, wherein the one or more sensors include one or more of infrared, ultrasonic, laser type sensors.

6. An apparatus as set forth in claim 4, wherein the one or more sensors include one or more of a contour sensor, a conveyor speed sensor, a height sensor and a width sensor.

7. An apparatus as set forth in claim 1, wherein the commanding means includes a logic device having one or more microprocessors.

8. An apparatus as set forth in claim 1, wherein the commanding means includes a modem.

9. An apparatus as set forth in claim 1, wherein the commanding means includes a switch.

10. A method of packaging, comprising the steps of:

identifying a desired void-fill density;

determining a void volume in a container; and commanding a dunnage dispenser to dispense an amount of dunnage to fill the void volume at the desired density.

11. A method as set forth in claim 10, comprising the step of dispensing a portion of the commanded amount of dunnage, stopping the dispensing, and then later dispensing an additional amount.

12. A method as set forth in claim 10, wherein the determining step includes sensing characteristic information of a container.

13. A method as set forth in claim 10, wherein the identifying step includes receiving from a selector device a selected void-fill density chosen from a plurality of densities.

14. A method as set forth in claim 10, comprising the step of varying the amount of dunnage commanded to be dispensed for a determined void volume based on predetermined criteria.

15. A method as set forth in claim 10, wherein the identifying step includes selecting a void-fill density from a plurality of void-fill densities based on predetermined criteria.

16. A method as set forth in claim 10, wherein the determining step includes processing sensed characteristic information.

17. A method as set forth in claim 10, comprising the step of converting a stock material into a dunnage product.

18. A method as set forth in claim 17, wherein the converting step includes converting a sheet stock material into a strip of dunnage.

19. A method as set forth in claim 11, wherein the dispensing step includes depressing a switch.

* * * * *